United States Patent [19]

Hoshino et al.

[11] 4,422,749

[45] Dec. 27, 1983

[54] DEVELOPING APPARATUS

[75] Inventors: Osamu Hoshino, Tokyo; Michio Ito, Hachiohji; Akihiko Takeuchi, Kawasaki, all of Japan

[73] Assignee: Canon Kabushiki Kaisha, Tokyo, Japan

[21] Appl. No.: 308,083

[22] Filed: Oct. 2, 1981

[30] Foreign Application Priority Data

Oct. 11, 1980 [JP] Japan ..... 55-142205
Oct. 11, 1980 [JP] Japan ..... 55-142206

[51] Int. Cl.[3] ..... G03G 15/09

[52] U.S. Cl. ..... 355/3 DD; 118/657; 118/661

[58] Field of Search ..... 355/3 R, 3 DD; 118/651, 118/656, 657, 658, 661

[56] References Cited

U.S. PATENT DOCUMENTS

| | | | |
|---|---|---|---|
| 3,203,394 | 8/1965 | Hope et al. | 355/3 DD X |
| 3,645,770 | 2/1972 | Flint | 355/3 DD X |
| 3,666,363 | 5/1972 | Tanaka et al. | 355/17 |
| 3,739,748 | 6/1973 | Rittler et al. | 355/3 DD X |
| 3,863,603 | 2/1975 | Buckley et al. | 118/658 |
| 3,950,089 | 4/1976 | Fraser et al. | 355/3 DD |
| 4,071,361 | 1/1978 | Marushima | 96/1.4 |
| 4,081,571 | 3/1978 | Nishihama et al. | 118/657 X |
| 4,292,387 | 9/1981 | Kanbe et al. | 118/657 X |
| 4,334,772 | 6/1982 | Suzuki | 355/3 DD |

*Primary Examiner*—Fred L. Braun

*Attorney, Agent, or Firm*—Fitzpatrick, Cella, Harper & Scinto

[57] ABSTRACT

A developing apparatus has developer conveying member for feeding developer to an electrostatic latent image bearing surface of an image formation apparatus. A high resistance layer is formed at the side of the developer conveying member facing an electrostatic latent image. A medium resistance layer is formed on the surface of the high resistance layer to provide self-bias effects and to allow developing without background fog.

28 Claims, 12 Drawing Figures

DEVELOPING APPARATUS

BACKGROUND OF THE INVENTION

1. Field of the Invention

The present invention relates to a developing apparatus for developing electrostatic latent images on an electrostatic latent image bearing surface such as a photosensitive or insulating material in electrophotography, electrostatic recording or the like.

2. Description of the Prior Art

In developing electrostatic latent images, a developer, i.e., a toner in charged particle form, is supplied to an electrostatic latent image bearing surface. The toner is attracted to the electrostatic latent image bearing surface in association with the electrostatic latent image pattern potential by the electrostatic attraction of the toner, thereby visualizing the electrostatic latent image. For image transfer, the toner visual image is transferred from the electrostatic latent image bearing surface to a transfer material and is then fixed by heat or pressure.

Various developing methods are known which are roughly classified into two categories: the dry developing method and the liquid (wet) developing method. The dry developing method is further classified into the two-component developing method which uses as a developer a mixture of a toner and carrier particles, and the one-component developing method which uses only a toner such as a magnetic toner. The liquid developing method uses a dispersion of a toner in a carrier solution such as a petroleum-type insulating liquid.

In all of these developing methods, a method for applying a bias voltage to the developing portion is generally adopted as a means for preventing the so-called background fog phenomenon wherein the toner becomes attached to regions other than the electrostatic latent image bearing surface region. When the bias voltage is applied, the toner does not become attached to the region of the image formation surface, that is, the electrostatic latent image bearing surface at which the surface potential is less than a predetermined threshold level, so that background fog may, thus, be prevented.

However, with this method, when the bias voltage is too low as compared with the surface potential of the electrostatic latent image bearing surface, background fog still occurs. When it is too high, the half-tone portions may become totally white or fine lines may become thinner or vanish. Therefore, the bias voltage to be applied must be carefully controlled according to the fluctuation in the surface potential of the electrostatic latent image bearing surface in order to constantly obtain images of good quality even in the case of changes in environmental factors.

Another method for preventing background fog is known which utilizes the so-called self-bias effects which are obtained when the developing electrodes for applying the bias voltage are placed under the electrically floating condition. When the developing electrodes are placed under the floating condition, the threshold level of the surface potential can be changed in accordance with the fluctuation in the surface potential of the electrostatic latent image bearing surface. In this manner, the bias voltage control need not be precise and may even be unnecessary.

It is, however, difficult in practice to effectively, stably utilize the self-bias effects.

SUMMARY OF THE INVENTION

It is an object of the present invention to provide a developing apparatus which performs developing without background fog by utilizing self-bias effects and which is capable of consistently providing developed images of excellent quality.

It is another object of the present invention to provide a developing apparatus which supplies charge to an electrostatic latent image bearing surface serving as a developing electrode to utilize the self-bias effects which allow stable control of the surface potential according to changes in environmental factors.

In order to achieve the above objects, the present invention provides a developing apparatus wherein a high resistance layer is formed on a surface (the surface facing an electrostatic latent image bearing surface; i.e., a developer conveying surface) of a developer conveying means which supplies developer to the electrostatic latent image bearing surface in an image formation apparatus, and a medium resistance layer is formed thereover. This developing apparatus is characterized by incorporating a means for supplying charge to the medium resistance layer which is the surface layer.

The above and other objects and features of the present invention will become apparent from the following detailed description when taken in conjunction with the accompanying drawings.

DETAILED DESCRIPTION OF THE PREFERRED EMBODIMENTS

The preferred embodiments of the present invention will now be described taking as an example a developing apparatus of so-called magnet sleeve developing type which uses a one-component magnetic toner.

Figure 1:
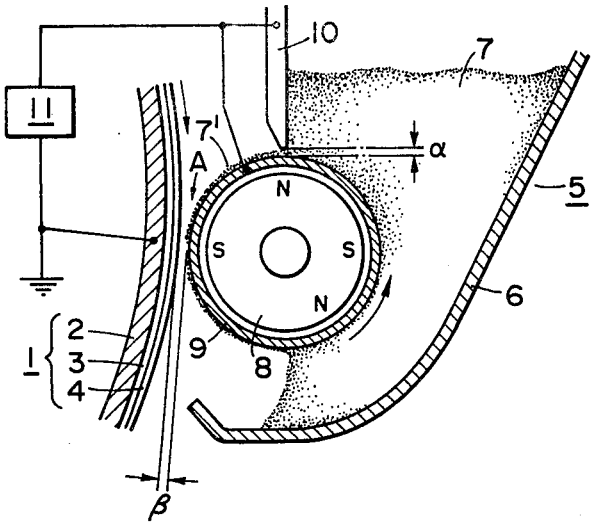
FIG. 1 is a sectional view of an example of a magnet sleeve type developing apparatus which uses a one-component magnetic toner.

Referring to FIG. 1, a photosensitive member 1 for electrophotography or an image formation member 1 such as an insulator for electrostatic recording comprises, in this example, a drum-type electrophotographic photosensitive member (to be referred to as a photosensitive drum or drum) which is obtained by, in sequence, winding over the circumferential surface of an aluminum drum base body 2, a photoconductive layer 3 of a photosemiconductor such as CdS, and a transparent insulator layer 4; or by winding over the circumferential surface of the base body 2, a sheet-like photosensitive body having as a base layer the photoconductive layer 3 and the transparent insulator layer 4. Assume that the drum 1 is rotating in the direction shown by the arrow and an electrostatic latent image of 450 V at the dark portion and 40 V at the light portion is formed on the insulator layer 4 by an electrophotographic processing device (not shown) as disclosed in U.S. Pat. Nos. 3,666,363 or 4,071,361.

A one-component toner 7 consisting primarily of, for example, polystyrene and magnetite is filled in a developer container 6 of a magnet sleeve developing apparatus 5 which sequentially developes the electrostatic latent images. A stationary magnet 8 is inserted into and fixed inside a nonmagnetic metallic sleeve 9 as a developer conveying member. The sleeve 9 is rotated about the magnetic 8 in the direction shown by the arrow. A portion of the toner 7 in the container 6 near the sleeve 9 is attracted by the magnetic force of the magnet 8 on the surface of the sleeve 9 and forms a layer. The toner 7 is, thus, distributed on the sleeve 9 as the sleeve 9 rotates, and is regulated in its thickness by a doctor blade 10. A bias voltage produced by an ac voltage biased by a dc voltage is applied to the sleeve 9 and the blade 10. The bias voltage may be either an ac voltage or a dc voltage. The toner carried on the surface of the sleeve 9 is charged by friction with sleeve 9, the blade 10 or the like. In this example, the toner is negatively charged.

A toner layer 7' obtained on the sleeve 9 and having uniform thickness after contact with the doctor blade 10, then reaches, upon subsequent rotation of the sleeve 9, a developing region A facing the photosensitive drum 1. At this region A, the toner of the toner layer 7' is transferred between the sleeve 9 and the surface of the insulator layer 4 of the photosensitive drum 1 by the action of the applied ac voltage. The toner finally becomes attached to the dark portion of the electrostatic latent image on the insulator layer 4 of the photosensitive drum 1 to visualize the latent image.

With the structure described above, assume that clearance $\alpha$ between the sleeve 9 and the doctor blade 10 of magnetic material is 240$\mu$, the minimum clearance $\beta$ between the sleeve 9 and the insulator layer 4 of the photosensitive drum 1 at the developing region A is 300$\mu$, and the amplitude of the ac voltage applied to the sleeve 9 and the doctor blade 10 is 1,800 V and the frequency thereof is 1,800 Hz. Under this condition, when the dc component for biasing the ac voltage is 70 V, background fog occurs. When it is about 80 to 90 V, an excellent image is obtained. When it exceeds 100 V, fine lines become thinner or vanish, providing unsatisfactory images (the width of the fine line latent image in this example is about 100$\mu$ and the potential is about 230 V).

In the example described above, the sleeve 9 serves as a developing electrode. When the bias voltage is too low in comparison with the surface potential of the photosensitive drum 1, background fog occurs. On the other hand, when it is too high, the half-tone part becomes whitish and the fine lines become thinner or vanish. Therefore, in this example, the bias voltage which is to be applied must precisely be controlled in accordance with the fluctuation in the surface potential of the photosensitive drum.

Figure 2:
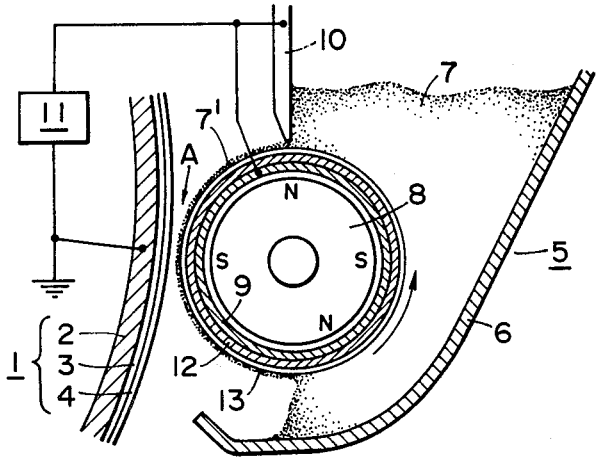
FIG. 2 is a sectional view of a resistance layer formed along the circumferential surface of the apparatus according to an embodiment of the present invention shown in FIG. 1.

FIG. 2 shows an embodiment in which, over the sleeve 9, the developer conveying member of the developing apparatus shown in FIG. 1, there is formed, in order, a high resistance layer 12 and a medium resistance layer 13 of the present invention. By the self-bias effects obtained by the incorporation of these layers, the formation of background fog may be prevented.

EXAMPLE 1

The high resistance layer 12 of about 200$\mu$ thickness was formed on the outer circumferential surface of the sleeve 9 by plasma spray coating an alumina powder (about $10^{14}$ $\Omega$-cm in volume resistivity) and sealing the pores of the coated alumina layer with an epoxy resin ($10^{14}$ $\Omega$-cm). The medium resistance layer 13 of about 50$\mu$ thickness was then formed on the surface of the high resistance layer 12 by plasma spray coating a mixture of alumina and 12% titania. Titania is an electrically conductive material, and a mixture of alumina and 12% titania is assumed to have a volume resistivity of about $10^{10}$ $\Omega$-cm.

In the above example, when alumina is coated by plasma spray coating for forming the high resistance layer 12 as the interlayer, the porosity of the formed alumina layer fluctuates in the range of 1 to 10%. Since the control of electrical resistance is difficult with this porosity, it is preferable to seal the pores with a resin or the like as in the example described above. As an agent for sealing the pores, resins other than epoxy resin, such as a phenol resin or tetrafluoroethylene resin, may be used. When epoxy resin is used as in the above example, the adhesion between the medium resistance layer 13 as the surface layer and the high resistance layer 12 becomes good.

In the apparatus shown in FIG. 2, the medium resistance layer 13, which is the surface layer formed above the high resistance layer 12 which, in turn, is the interlayer on the circumferential surface of the sleeve, acts as a developing electrode which is placed under the floating condition. With the self-bias effects obtained with this medium resistance layer 13, excellent images without thinning or vanishing of fine lines were obtained in a stable manner when the dc bias voltage, as a sum of an ac voltage and a dc voltage applied to the sleeve 9, was in the range of 80 to 120 V. Therefore, as compared with the apparatus shown in FIG. 1 wherein the tolerance of the dc voltage is about 80 to 90 V, the tolerance of the dc voltage to be applied in the apparatus shown in FIG. 2 is 80 to 120 V, that is, four times as much as that obtainable by the apparatus shown in FIG. 1.

EXAMPLE 2

The high resistance layer 12, as the interlayer, was formed in the same manner as in Example 1. As for the medium resistance layer 13, as the surface layer, (1) one with a thickness of 50$\mu$ and a volume resistivity of $10^{10}$ $\Omega$-cm and (2) another with a thickness of 50$\mu$ and a volume resistivity of $10^{12}$ $\Omega$-cm were formed by coating a quaternary ammonium salt on the circumferential surface of the high resistance layer 12. The sleeves 9 thus obtained were used under the same conditions as in Example 1, and similar results as in Example 1 were obtained for both items (1) and (2) above.

EXAMPLE 3

The high resistance layer 12 as the interlayer was formed in the same manner as in Example 1. The medium resistance layer 13, as the surface layer, was formed by winding over the surface of the high resistance layer 12 a transparent adhesive tape (trade name: Cellotape, $10^8$ to $10^{11}$ Ω-cm in volume resistivity) for general office use. The sleeve 9 thus obtained was used in the same manner as in Example 1 and similar results as in Example 1 were obtained.

Although not every aspect of the mechanism of the self-bias effects obtained according to the present invention is completely understood, the following is known.

Figure 3A:
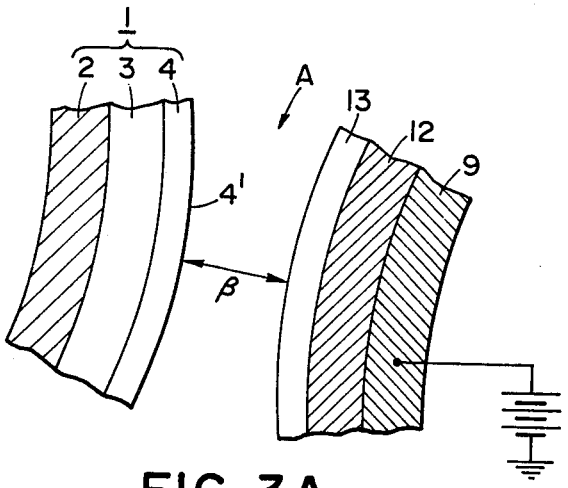
FIG. 3A is an enlarged sectional view of a developing region of the apparatus shown in FIG. 1.
Figure 3B:
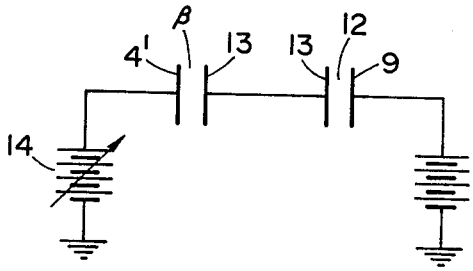
FIG. 3B is an equivalent circuit diagram thereof.

FIG. 3A is an enlarged partial view of the developing region A where the photosensitive drum 1 faces the sleeve 9. On sleeve 9 there are coated the resistance layers 12 and 13, with which sleeve 9 acts as the developer conveying member. Assuming that the high resistance layer 12 has a sufficiently high resistance, the medium resistance layer 13 has a sufficiently low resistance, and a photosensitive drum surface 4' serves as an electrode, the high resistance layer 12 and the clearance $\beta$ at the developing region A may be considered to form a series-connected capacitor circuit upon application of a dc voltage to the nonmagnetic material of sleeve 9. FIG. 3B shows an equivalent circuit diagram of this series circuit wherein the surface potential of the photosensitive drum 1 is shown as forcibly varied by a variable power source 14.

Figure 3C:
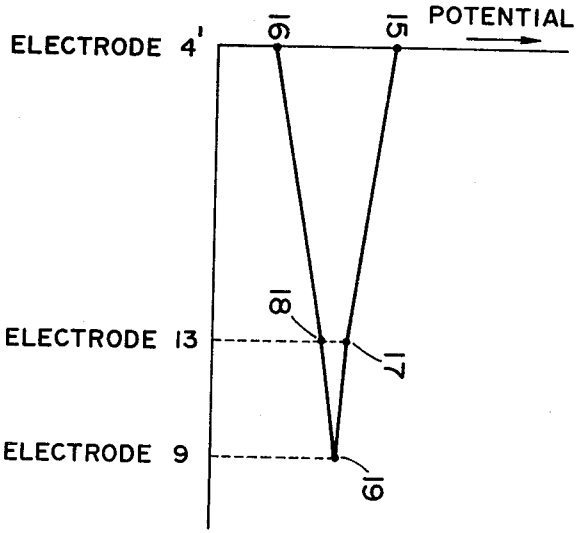
FIG. 3C is a graph showing the self-bias effects.

Assume that the surface potential of the photosensitive drum set by the power source 14 is an average value of the white and black portions of the electrostatic latent image. When the average value of the surface potential of the photosensitive drum surface 4', that is, the electrode, fluctuates by environmental factors from a point 15 to a point 16 on the ordinate in FIG. 3C, the potential (point 19) of the sleeve 9 (electrode) remains unchanged. Also, a voltage of the medium resistance layer (surface layer of the sleeve) 13, as the actual developing electrode, changes from a value 17 to a value 18 which is obtained by dividing the potential difference between the electrode 4' and the sleeve 9 by the capacitance of the series circuit formed by the high resistance layer 12 and the clearance $\beta$ with the power source 14.

If the resistance layers 12 and 13 are not formed on the circumferential surface of the sleeve 9, the potential of the sleeve 9, as the developing electrode, remains constant even if the surface potential of the photosensitive drum changes. However, when these resistance layers are formed, the potential of the medium resistance layer 13, as the surface layer of the sleeve and as the actual developing electrode, naturally changes according to the change in the surface potential of the photosensitive drum, thus providing the self-bias effects.

The description has been made with reference to a simulation model. Therefore, the following points must be taken into consideration when practicing the present invention.

(1) With a higher resistance of the high resistance layer 12, the floating potential of the medium layer 13, as the developing electrode, increases. However, the charge for charging the toner by friction for developing is supplied from the sleeve 9 through, in the following order, the layers 12 and 13. Therefore, when the resistance of the high resistance layer 12 is too high, the charge supply becomes deficient. As the developing time continues, the amount of attached toner decreases and the image becomes less distinct.

The upper limit of the resistance of the high resistance layer 12 must be determined so that the charge on the toner may not be deficient. Within the allowable range it is, however, preferable to allow the medium resistance layer 13, as the developing electrode, to float as much as possible.

(2) When the resistance of the medium resistance layer 13 is too high, self-bias effects occur locally. With a greater area of black background, the distinctness of the formed image is degraded. With a greater area of white background, background fog occurs. When the resistance of the medium resistance layer 13 is too low, the potential of the layer 13 is affected by the potential of the toner at the doctor blade 10 and within the developer container 6. Then, the layer 13 may not be electrically floated and the self-bias effects may not be obtained.

The lower limit of the resistance of the layer 13 must be determined so that the blade 10 and so on does not affect the potential of the layer 13 during developing. The upper limit of the resistance of the layer 13, however, must be determined so that the self-bias effects do not occur locally and the potential may stay substantially constant along the axial direction of the sleeve 9.

Figure 4:
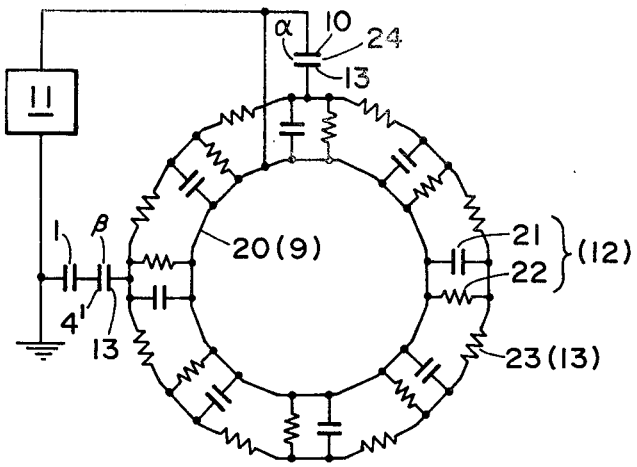
FIG. 4 is an equivalent circuit diagram of the apparatus shown in FIG. 2.

FIG. 4 is an equivalent circuit diagram of the developing apparatus according to the present invention; it is more detailed than the equivalent circuit diagram shown in FIG. 3B. The sleeve 9 is considered to be equivalent to a circular conductor 20. The high resistance layer 12 is considered to be equivalent to an array of indefinite number of parallel circuits each consisting of a capacitor 21 and a resistor 22 arranged around the outer circumference of the circular conductor 20. The medium resistance layer 13 is considered to be equivalent to an indefinite number of resistors 23 connecting each parallel circuit of the capacitors 21 and the resistors 22. The clearance $\alpha$ between the doctor blade 10 and the medium resistance layer 13 is considered to be equivalent to a capacitor 24.

Comparative Example

When the high resistance layer 12 was made of an epoxy resin alone, the developed image gradually became less distinct. When the charge on the sleeve 9 was measured, it was found that the amount of charge on the sleeve was deficient as compared with the amount of charge dissipated by the toner. When the sleeve 9 was made of an aluminum alloy and its outer circumference was treated with Alumite and the pores were sealed to form the high resistance layer 12, the range of tolerance of the dc voltage was not increased. The resistance of this high resistance layer 12 was measured to be only about that obtainable by an electrical conductor.

The high resistance layer 12 must have a resistance and a thickness sufficient to allow the medium resistance layer 13 as the developing electrode to electrically float, and its resistance must, at the same time, be such that a current to compensate appropriately for the charge dissipated by the toner may flow.

In practice, the volume resistivity of the high resistance layer 12 is preferably within the range of $10^{10}$ to $10^{14}$ Ω-cm from the various experiments conducted. It is to be noted that the volume resistivity must be selected according to the thickness of the layer 12.

When the medium resistance layer 13 was made of nickel chrome or an alumina-titania mixture containing 40% titania, the allowable range for the tolerance of the dc voltage was not increased. This is attributed to the fact that the layer 13 as the developing electrode is not electrically floated by the electric field of the blade 10.

When the medium resistance layer 13 was made of alumina or an alumina-titania mixture containing 2% titania, the area affected by the self-bias effects becomes very small. Therefore, the portion surrounding the black part becomes white, but the white part of a greater area is subject to background fog.

The medium resistance layer 13 therefore, must have a resistance which is great enough so that it may not be affected by the effects other than the electric field of the electrostatic latent image. At the same time, the upper limit of this resistance must be such that the self-bias is applied uniformly along the axial direction of the sleeve. Although the volume resistivity of this layer 13 is assumed to be $10^8$ to $10^{12}\Omega$-cm, it is determined according to the construction of the developing apparatus, the thickness of the medium resistance layer and so on.

The above description has been made by referring to an example of a so-called magnet sleeve developing apparatus which uses a one-component magnetic toner. However, by forming the layers 12 and 13 on the developer conveying member, the present invention is also applicable to other types of developing apparatuses which use a belt-type sleeve, a two-component developer, or another developing method. It is to be understood that the present invention may also be applied to liquid developing by forming the layers 12 and 13 on the developing electrode.

In summary, in accordance with the present invention, the self-bias effects provide consistently stable developed images without background fog.

The construction which utilizes the self-bias effects as described above is advantageous as compared to the developing apparatus as shown in FIG. 1 wherein the bias is directly applied to the developing region A from the sleeve 9 as the developer conveying member, since the allowable tolerance of the dc voltage to be applied becomes four times as much as that obtainable with the construction shown in FIG. 1. However, the construction utilizing the self-bias effects still has a problem which calls for an improvement.

The developing of the electrostatic image may be considered to be the transfer of the toner, and therefore static charge, from the sleeve 9, as the developer conveying member, to the photosensitive drum 1 through the clearance $\beta$. In the example of the embodiment of the present invention, the negatively charged toner, that is, negative charge, is transferred from the sleeve 9 to the drum 1 through the clearance $\beta$. Therefore, when the resistance of the high resistance layer 12 is too high, the negative charge on the toner becomes deficient and the density of the visualized image decreases with the increase in the number of sheets developed. Although the resistance of the high resistance layer 12 may be decreased, a decrease in the resistance results in a decrease in the floating potential of the medium resistance layer 13 as the developing electrode, and thus in a decrease in the self-bias effects. In order to balance the amount of charge injected and the self-bias effects, it is conceivable to form the layer 12 of a material which has a volume resistivity of $10^{10}\Omega$-cm. However, since the resistance of the formed layer may change with changes in ambient temperature or humidity, it is extremely difficult to maintain the resistance of the layer 12 at a specific value.

In order to solve this problem, the present invention provides a developing apparatus which utilizes self-bias effects that are stable against changes in the environment, which may not cause charge supply deficiency to the toner even if the high resistance layer 12 has a high resistance, and which provides a great floating potential to the layer 13 as the developing electrode. This developing apparatus is characterized in that the high resistance layer 12 and the medium resistance layer 13 are sequentially formed on the surface of the sleeve 9, as the developer conveying member, and a charge supply means is incorporated in the medium resistance layer 13.

Figure 5:
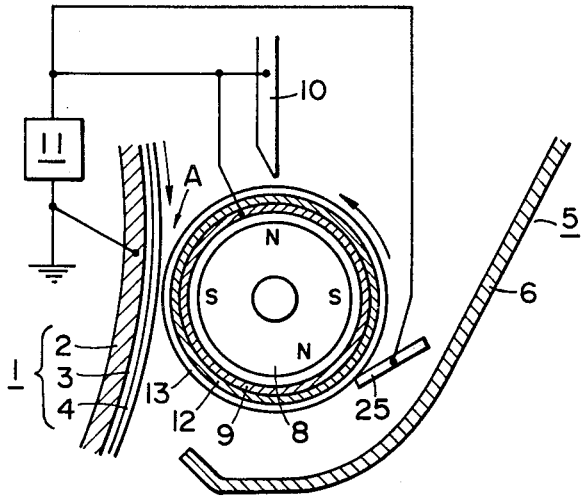
FIG. 5 is a sectional view of the apparatus shown in FIG. 2 further incorporating a charge supply means according to another embodiment of the present invention.

In the embodiment shown in FIG. 5, as the charge supply means, a charge supply blade 25 is provided in contact with the surface of the medium resistance layer 13, as the surface layer, and the blade 25 is connected to a power source 11.

Figure 6:
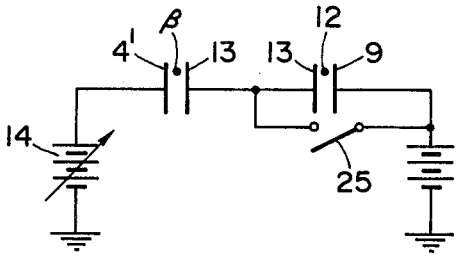
FIG. 6 is an equivalent circuit diagram of the apparatus shown in FIG. 5.

FIG. 6 is an equivalent circuit diagram of the apparatus shown in FIG. 5 wherein the blade 25 is represented as a switch. The switch 25 is opened and the layer 13, as the electrode, floats during development. After the development, the switch 25 is closed in order to supplement the charge which has been dissipated by the toner. This operation is repeated at every rotation of the sleeve.

With this construction, charge supply deficiency may not occur and the floating potential of the layer 13 as the electrode during developing increases even if the high resistance layer 12 has a high resistance. Therefore, a developing apparatus is provided which utilizes the self-bias effects and which is stable against changes in the environment.

With the apparatus according to this embodiment, the range of the allowable dc voltage, that is, 80 to 180 V, becomes as much as ten times the range, about 80 to 90 V, obtainable with the apparatus shown in FIG. 1.

Figure 7:
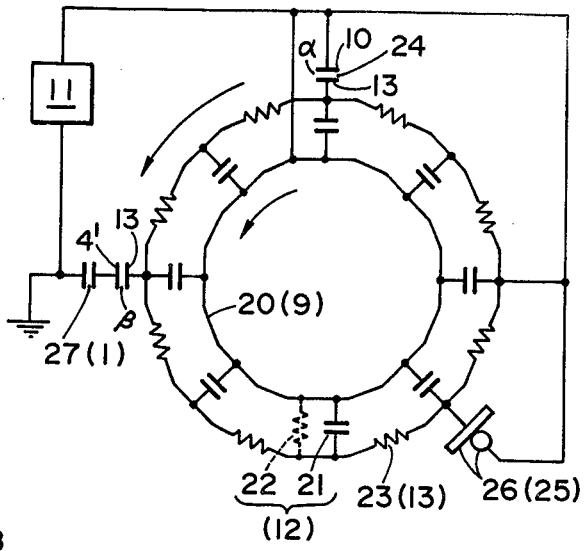
FIG. 7 is an equivalent circuit diagram of the sleeve circumference of the apparatus shown in FIG. 5.

FIG. 7 is an equivalent circuit diagram of the apparatus shown in FIG. 5 as viewed along the circumference of the sleeve. The sleeve 9 forms the circular conductor 20. The high resistance layer 12 as the interlayer is considered to be an array of an indefinite number of parallel circuits each consisting of the capacitor 21 and the resistor 22 arranged around the outer circumference of the circular conductor 20. The medium resistance layer 13 as the surface layer is considered to be a series circuit of an indefinite number of the resistors 23 connecting the capacitors 21 and the resistors 22. The charge supply blade 25 is represented as a slip ring 26, and the doctor blade 10 is represented as the capacitor 24. When the photosensitive drum 1 is of a three-layered structure, the insulator layer 4 and the photoconductive layer 3 are considered to be equivalent to a capacitor 27. The electrostatic latent image on the surface 4', the electrode of the photosensitive drum 1, is charged by the electrostatic latent image formation process. The developing region A is considered to be equivalent to a capacitor consisting of the medium resistance layer 13, as the developing electrode, the clearance $\beta$, and the electrode 4'. During the developing operation, negative charge is transferred from the layer 13 to the electrode 4' by the toner.

With this construction, the medium resistance layer 13, as the developing electrode, floats under the influence of the electrode 4'. The layer 13 rotates after the development and is supplied with charge at the slip ring 26.

The medium resistance layer 13, as the developing electrode, must be electrically floated. It is preferable for the resistor 23 to have a high resistance for this purpose. However, when this resistor 23 has too high a resistance, the area subjected to the self-bias effects becomes smaller, a black portion of greater area becomes less distinct, and a white portion of greater area is subject to background fog. Therefore, the resistance of the resistor 23 must be such that the resistance of the medium resistance layer 13 may be regarded as substantially the same along the axial direction of the sleeve. On the other hand, if the resistance of the resistor 23 is too low, the medium resistance layer 13, as the developing electrode, is directly under the influence of the potential of the slip ring 26 and the doctor blade 10, so that the self-bias effects may be lost.

The upper limit of the resistance of the medium resistance layer 13, as the surface layer, is determined by the self-biased area, and the lower limit, thereof is determined to maintain the required potential difference between the slip ring 26 and the doctor blade 10.

The high resistance layer 12, as the interlayer, must have a volume resistivity of $10^{14}\Omega$-cm. When the layer 12 is made of other materials of high resistance such as an epoxy resin, it lacks mechanical strength. When the sleeve is made of aluminum and the Alumite layer is formed thereover, electrical conduction is observed beween the sleeve 9 and the medium resistance layer 13 as the surface layer and the self-bias effects are not obtainable even if the pores of the Alumite layer are sealed. When the layer 12 is formed by plasma spray coating by an alumina powder, it had excellent mechanical and electrical insulating characteristics.

The volume resistivity of the medium resistance layer 13, as the surface layer, must be controlled within the range of $10^8$ to $10^{12}\Omega$-cm. When the metallic blade 25 is used as the charge supply means, the problem of abrasion resistance of the layer 13 arises. When a resin or rubber is used for the layer 13, the volume resistivity of the layer 13 may be easily controlled while the problem of the abrasion resistance still remains unsolved.

When the layer 13 is formed by plasma spray coating a mixture of an alumina powder with a titania powder, the volume resistivity of the formed layer may be easily varied by changing the mixing ratio of the powders, and excellent abrasion resistance may also be obtained.

Figure 8:
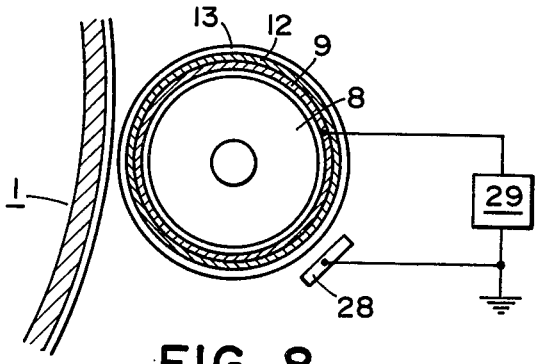
FIGS. 8 to 10 are sectional views of developing apparatuses incorporating various types of charge supply means according to other embodiments of the present invention.
Figure 9:
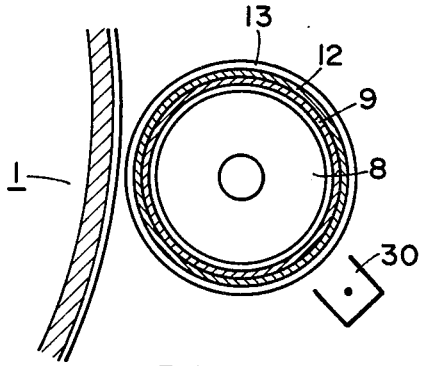
Figure 10:
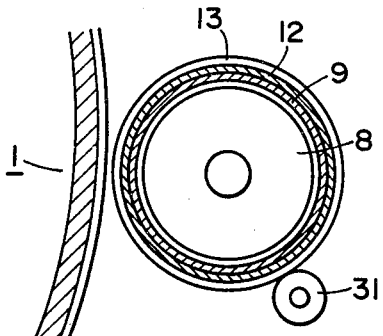

In place of the blade contact method shown in FIG. 5, other charge supply means may be adopted. For example, as shown in FIG. 8, an electrode 28 is arranged near the medium resistance layer 13 of the sleeve, and an ac electric field is applied by an ac power source 29 between the electrode 28 and the sleeve 9 to transfer the toner between the sleeve 9 and the electrode 28, so that charge may be supplied to the toner through contact with the electrode 28. Alternatively, as shown in FIG. 9, charge may be supplied by a corona discharge 30. Still alternatively, as shown in FIG. 10, charge may be supplied by rotating a cylindrical electrode 31 in contact with the drum 1.

The description has been made with reference to a magnet sleeve developing apparatus which uses a one component magnetic toner. However, by forming the layers 12 and 13 as described above on the developer conveying member, the present invention is similarly applicable to other types of developing apparatuses which use a belt-type sleeve, a two-component developer, or another developing method. It is to be noted that the present invention is similarly applicable to the liquid developing method by forming the layers 12 and 13 on the developing electrode and incorporating the charge supply means.

In summary, in accordance with the present invention, the self-bias effects may be sufficiently utilized, so that developed images may be obtained without background fog and in a stable manner.

We claim:

1. A developing apparatus for supplying developer to an electrostatic latent image on an electrostatic latent image bearing member for developing the latent image, comprising:

developer conveying means with developer on a surface thereof for conveying the developer to a developing region, said developer conveying means including a high resistance layer on a developer conveying surface thereof and a medium resistance layer formed thereover and having a volume resistivity of $10^8$ to $10^{12}$ $\Omega$cm;

means for supplying the developer to said developer conveying means; and means for applying a developing bias voltage to said developer conveying means.

2. An apparatus according to claim 1, wherein said high resistance layer is made of alumina and said medium resistance layer is made of a mixture of alumina and titania.

3. An apparatus according to claim 2, wherein the mixture of alumina and titania contains about 12% by weight of titania.

4. An apparatus according to claim 1, wherein said high resistance layer is made of alumina and said medium resistance layer is made of a quaternary ammonium salt.

5. An apparatus according to claim 1, wherein said high resistance layer is made of alumina and said medium resistance layer includes a transparent adhesive tape which has a volume resistivity of $10^8$ to $10^{11}$ $\Omega$-cm and is adhered to a surface of said high resistance layer.

6. An apparatus according to any one of claims 1 to 5, wherein said high resistance layer is formed by plasma spray coating alumina on a surface of said developer conveying means and sealing pores of a layer formed thereby with a sealing agent.

7. An apparatus according to claim 6, wherein said sealing agent is an epoxy resin.

8. An apparatus according to any one of claims 1 to 5, wherein said high resistance layer has a volume resistivity of $10^{10}$ to $10^{14}$ $\Omega$-cm.

9. A developing apparatus for supplying developer to an electrostatic latent image on an electrostatic latent image bearing member for developing the latent image, comprising:

developer conveying means with developer on a surface thereof for conveying the developer to a developing region, said developer conveying means including a high resistance layer on a developer conveying surface thereof and a medium resistance layer formed thereover and having a volume resistivity of $10^8$ to $10^{12}$ $\Omega$cm;

means for supplying the developer to said developer conveying means;

means for applying a developing bias voltage to said conveying means; and means for supplying charge to said medium resistance layer as a surface layer.

10. An apparatus according to claim 9, wherein said high resistance layer is made of alumina and said medium resistance layer is made of a mixture of alumina and titania.

11. An apparatus according to claim 10, wherein the mixture of alumina and titania contains about 12% by weight of titania.

12. An apparatus according to claim 9, wherein said high resistance layer is made of alumina and said medium resistance layer is made of a quaternary ammonium salt.

13. An apparatus according to claim 9, wherein said high resistance layer is made of alumina and said medium resistance layer includes a transparent adhesive tape which has a volume resistivity of $10^8$ to $10^{11}$ Ω-cm and is adhered to a surface of said high resistance layer.

14. An apparatus according to any one of claims 9 to 13, wherein said high resistance layer is formed by plasma spray coating alumina on a surface of said developer conveying means and sealing pores of a layer formed thereby with a sealing agent.

15. An apparatus according to claim 14, wherein said sealing agent is an epoxy resin.

16. An apparatus according to any one of claims 9 to 13, wherein said high resistance layer has a volume resistivity of $10^{10}$ to $10^{14}$ Ω-cm.

17. An apparatus according to claim 9, wherein said charge supplying means includes an electrode disposed in contact with or near said developer conveying means.

18. An apparatus according to claim 9, wherein said charge supplying means includes a corona discharger.

19. An apparatus according to claim 9, wherein said charge supplying means includes a roller-shaped electrode disposed in contact with said developer conveying means.

20. An apparatus according to claim 1 or 9, wherein said developing bias voltage applying means applies an dc voltage to said developer conveying means.

21. An apparatus according to claim 1 or 9, wherein said developing bias voltage applying means applies an ac voltage to said developer conveying means.

22. An apparatus according to claim 1 or 9, wherein said developing bias voltage applying means applies an ac voltage biased with a dc voltage to said developer conveying means.

23. An apparatus according to claim 1 or 9, wherein said developer conveying means includes a nonmagnetic cylinder and a magnet disposed therein.

24. An apparatus according to claim 23, wherein the developer is a one-component toner.

25. An apparatus according to claim 23, wherein the developer is a two-component developer including a toner and a carrier.

26. An apparatus according claim 1 or 9, wherein the developer is a liquid developer.

27. A developing apparatus for developing an electrostatic latent image on an electrostatic latent image bearing member, comprising:

an electrically conductive nonmagnetic sleeve being rotatably disposed relative to said electrostatic latent image bearing member, said sleeve having, on an outer circumference thereof, a high resistance layer which is formed by plasma spray coating an alumina powder and sealing pores of the alumina coated layer formed thereby with an epoxy resin, and having, a medium resistance layer which is formed on a surface of said high resistance layer by plasma spray coating a mixture of alumina and 12% titania;

a magnet roller being fixed within said sleeve;

a hopper for supplying a one-component magnetic toner on a surface of said sleeve;

a magnetic doctor blade being arranged near said sleeve and in opposition to magnetic poles of said magnet roller, a clearance between said magnetic doctor blade and said sleeve being smaller than a clearance between said sleeve and said electrostatic latent image bearing member; and a power source for applying an ac developing bias voltage biased with a dc voltage between said sleeve and said electrostatic latent image bearing member.

28. An apparatus according to claim 27, further comprising means for supplying charge to said medium resistance layer as a surface layer.

* * * * *